United States Patent [19]

Sanger

[11] Patent Number: 4,943,097

[45] Date of Patent: Jul. 24, 1990

[54] MANUALLY OPERABLE PERSONAL CONVENIENCE IMPLEMENT

[75] Inventor: Sampson D. Sanger, Liberty, N.Y.

[73] Assignee: Yehuda Naim, Floral Park, N.Y.

[21] Appl. No.: 297,926

[22] Filed: Jan. 17, 1989

[51] Int. Cl.[5] ..... A47G 25/90

[52] U.S. Cl. ..... 294/19.1; 294/24; 223/111

[58] Field of Search ..... 294/19.1, 23.5, 24; 223/111, 112, 113

[56] References Cited

U.S. PATENT DOCUMENTS 3,692,217 9/1972 Smith ..... 223/111
4,066,194 1/1978 Leland ..... 223/111
4,620,737 11/1986 Sanger ..... 294/19.1
4,651,909 3/1987 Banting ..... 223/111

FOREIGN PATENT DOCUMENTS 717012 10/1966 Italy ..... 223/111

*Primary Examiner*—Margaret A. Focarino
*Assistant Examiner*—Dean J. Kramer
*Attorney, Agent, or Firm*—Collard, Roe & Galgano

[57] ABSTRACT

A manually operable multi-functional convenience implement consists of a longitudinal arm with multiple concavities on a wedged half conical on one end with a hook device on the opposite end.

1 Claim, 3 Drawing Sheets

MANUALLY OPERABLE PERSONAL CONVENIENCE IMPLEMENT

BACKGROUND OF INVENTION

Many activities of daily living are difficult not only for the physically handicapped, but also for others whose full range of motion is either minimally restricted or difficult to achieve. Such activities as dressing and undressing are extremely difficult for persons who cannot bend forwardly at the waist, move either or both of their lower extremeties or use one of their upper extremeties, the latter due to disability or restriction of the use of one or more of the shoulder, upper arm, forearm, wrist or hand.

For instance, as simple, a task as donning or removing a stocking is difficult enough one-handed, but nearly impossible if one cannot easily bend forwardly at the middle or move the leg either in its entirety or at the knee. Persons who have restricted movement of the lower spine due to age, disease, traumer or obesity find it difficult to reach their feet even if the hip and knee joints are mobile and the leg musculature functional. Even if fully flexible at the waist, it is difficult to reach the feet if both the hips and knees are not fully mobile and the leg musculature functional. Any combination of disabilities of the lower spine, upper spine, hip and knee joints and leg back or abdominal muscles can make such tasks as donning and removing shoes, stockings, hose and trousers extremely difficult even with fully functioning upper extremeties. If, in addition, one of the upper extremeties has limited function or range of motion, the problem is compounded in the extreme. Achieving mastery of activities of daily living, maintenance of the home and usefulness in the work environment is essential to both physical and psychological rehabilitation.

A wide variety of adaptive devices have been devised for the physically handicapped. However, in many instances they are useful only under limited circumstances and not useful for a wide variety of physical disabilities for a wide variety of purposes. No singular device is available to assist the handicapped or physically restricted to don and remove shoes, stockings, hose, pantyhose, underwear, trousers and retrieve aforesaid from the floor, shelves, etc., including my previous invention U.S. Pat. No. 4,620,737, Nov. 4, 1986.

SUMMARY OF INVENTION

A manually operable multi-functional personal convenience implement consisting of a single longitudinal arm with a wedged half conical; multipal concavities on the periphery and rear of wedged conical act to restrict slippage of sock, hosiery, etc. until aforesaid sock, hosiery etc., accepts inserting foot completely over heel and ankle onto calf.

It is among the objects and advantages of the present invention to provide a manually operable, multi-functional, personal convenience implement to assist in donning and removing shoes, stockings, hose, pantyhose, underwear and trousers and the retrieving of aforesaid.

The object and advantages of this invention over my previous invention U.S. Pat. No. 4,620,737 of Nov. 4, 1986 is that its method of construction is increased because it is of singular construction rather than multiple parts and can be manufactured from plastic (single cavity injection mold); metal, or any other applicable material; which is durable and can be cleaned and disinfected without damage; therefore, the cost to construct is greatly reduced.

Another object and advantage of this invention is that it's effeciency is comparable or perhaps better because it is less cumbersome and complicated to use.

Shoe horn type tip to assist in removal of sock and hosiery and assist the foot into shoe or boot. Hook device on opposite end of longitudinal arm to assist in donning and removal of undergarments and hose; hook also assists in retrieval of undergarments and hose, etc. from floor and other places difficult to reach because of disability.

BRIEF DESCRIPTION OF DRAWINGS

The objects and advantages aforesaid, as well as other objects and advantages can be achieved by the implement disclosed and claimed herein, a preferred embodiment of which is illustrated in the drawings in which:

DESCRIPTION OF DRAWINGS

Figure 1:
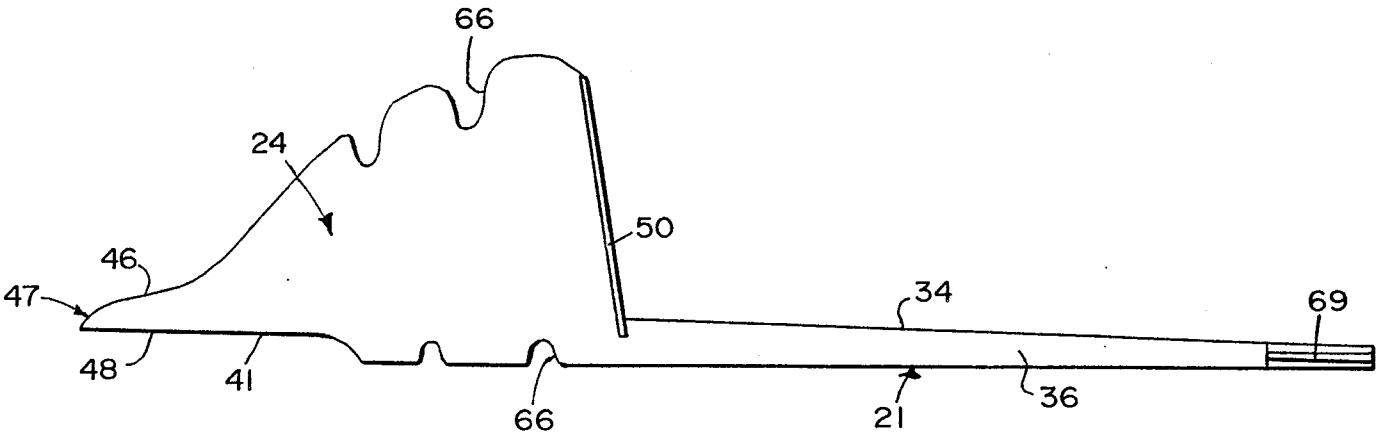
FIG. 1 is a side elevational view of a preferred embodiment of the multi-functional implement for the physically impaired.

Referring now to the drawings in detail, specifically FIGS. 1, 2, 3, 4, 5 and 6. The free end of the arm 21 is provided with a smoothly contoured wedge 24. The arm 21 (FIGS. 2 and 3) consists of a closed bottom 34 and side walls, 35 and 36 preferrably formed integrally with the bottom 34. Arm 21 is provided with transverse ribs 37, and cross number 38.

The free end of arm 21 is provided with a smoothly-contoured wedge 24. The wedge 24 is provided with a smoothly-contoured upper surface 41.

Figure 2:
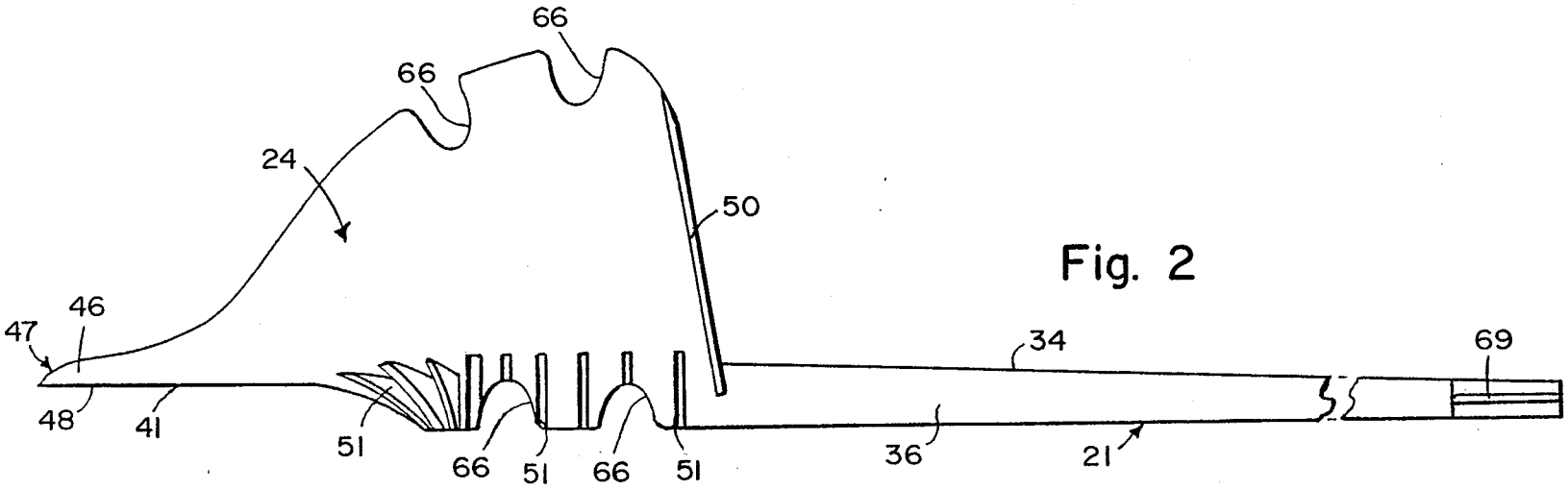
FIG. 2 is a side elevational view of the longitudinal arm of the implement.
Figure 3:
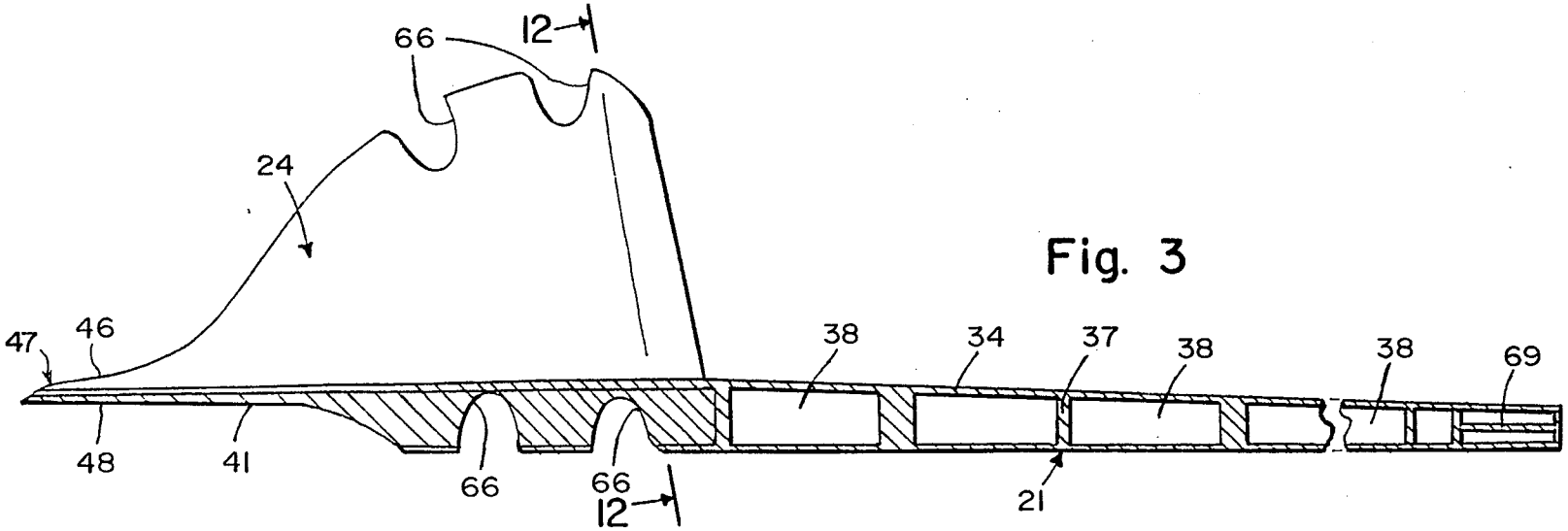
FIG. 3 is a side-elevational, cross-sectional view of the arm of the implement.
Figure 4:
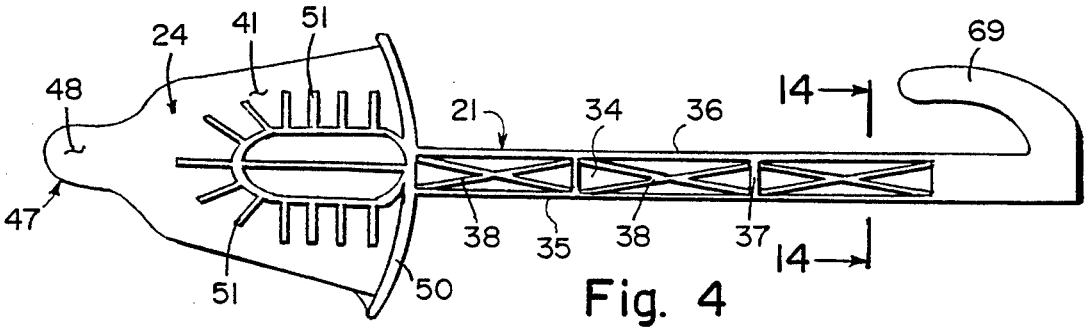
FIG. 4 is a top plan view of the arm of the implement.
Figure 5:
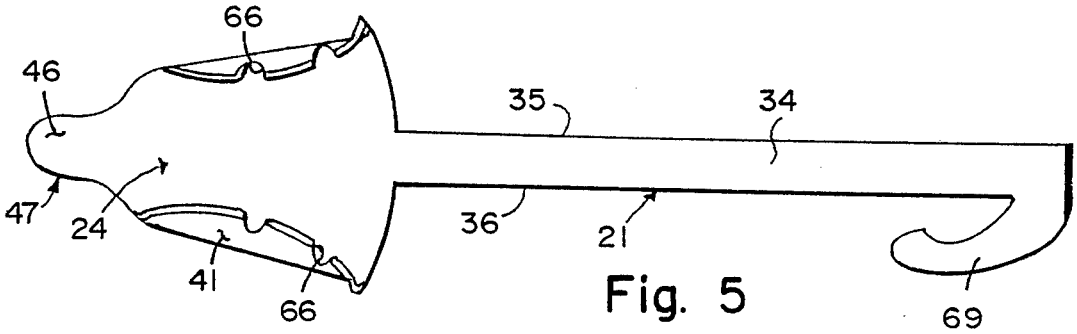
FIG. 5 is a bottom-plan view of the arem of the implement.
Figure 6:
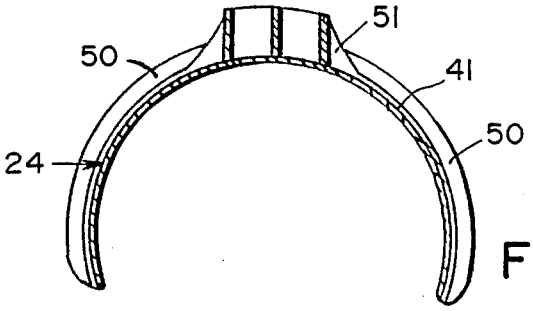
FIG. 6 is an oblique and elevational cross-sectional view of the arm of the implement taken along line 12—12 in FIG. 3 looking in the direction of arrows.
Figure 7:
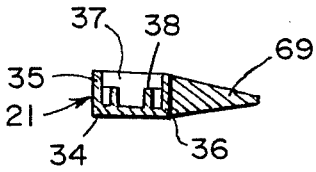
FIG. 7 is a rear-elevational, cross-sectional, view of the lower arm of the implement taken along line 14—14 in FIG. 4 looking in the direction of the arrows.

Viewed from above as illustrated in FIGS. 4 and 5 the wedge 23 tapers in the direction of the free end of arm 21. Viewed from the side as illustrated in FIGS. 1 and 2 the wedge 24 tapers arcuately upwardly towards the plane of the bottom 34 of the arm 21 terminating in a tip 47 which has a generally arcutate lower surface 48 and preferrably a generally arcuate upper surface 46 the rear most portion of the wedge 21 is provided with a radially outwardly flair tip portion 50. Wedge 24 is also provided with concavities 66 having rounded edges as shown in FIGS. 1, 2, 3, and 5.

The portion of the upper surface 41 of wedge 24 at the free end of arm 21 is provided with structural stiffening ribs 51 which also incorporates concavities 66 as in FIGS. 1, 2, 3, and 5. Opposite end of arm 21 is provided with hook 69 as in FIGS. 4 and 5.

The implement has multi-functional characteristics merely by way of illustration, it may be employed to both don and remove socks in the following maner. In order to don a sock, the sock is pulled over the wedge 24 beginning with the tip 47 up to concavities and preferably over the radially outwardly flared portion of flange 50 with a portion of the sock overlying the ribs 51 alternatively the top of the sock could be engaged in concavities 66 to prevent slippage. preferably the sock is disposed on wedge 24 with the heel disposed on concavities 66 with the heel over stiffening ribs 51 and concavities 66.

The tip 47 pointing in the direction of the toe of the sock. The sock should be gathered on the entire surface 41 of the wedge 24. Toe of sock to be in direct contact with tip 47.

With the implement held in hand the user reaches downwardly to his feet, intruding the toes of one of the feet into the opening provided at the rearmost portion of wedge 24. The user then retracts the implement and with the sock firmly engaged by means of tension on the wedge 24 and into the concavities 66, to prevent sippage; it is drawn upwardly, pulling the sock onto the foot.

In order to remove the sock effectively the reverse procedure is employed. The tip 47 of wedge 24 is inserted between the sock and the leg at the rear of the leg. The wedge 24 may be pointed from the leg or towards the leg. The implement is then pushed downwardly along the rear of the leg and foot removing the sock. Of course, the radially outwardly flared portion 50 on the wedge 24 is useful to prevent the sock from riding over and past the wedge 24.

Normally a person sufficiently handicapped to employ the implement will not employ laced shoes but rather loafers in the following fashion. The tip 47 of wedge 24 is intruded into the space between the foot and the shoe at the heel and pushed downwardly to remove the shoe. The shoe may be donned by placing the foot into the open portion of the shoe and employing the tip 47 as a shoe horn.

The implement may be employed in analogous fashion to don and remove undergarments. In donning the undergarment such as undershorts, panties, pantyhose and the like, the article is grasped by the hook 69 on opposite end of wedge 24 of arm 21. The garment may then be lowered to a position at the end of the foot and the foot placed into the garment in the usual fashion. of course, the arm 21 is made sufficiently long so as to make unnecessary for the user to bend significantly at the waist. The garment is then drawn upwardly until it can be reached by hand or with the implement to the final position.

The implement may be employed to pick up articles off the floor or shelf by merely engaging the article on hook 69 and retrieving it by pulling it upward, downward or towards so that it can be reached by hand.

The wedge 24 is also useful as a foot and back scratcher and may also be employed to activate switches such as electric light wall switches. This can be quite important to persons lacking lower extremity mobility, particularly if wheel-chair bound or bed-ridden.

Numerous modifications and variations of the present invention are possible in light of the above teachings and, therefore, within the scope of the appended claims the invention may be practiced otherwise as particularly described.

What is claimed is:

1. A manually operable, multi-functional personal convenience implement comprising a device having an elongated arm having a first end and a second end with a portion of a conical wedge section having two converging edges at said first end;

said wedge having concavities on the converging edges of said wedge with said concavities separated a spaced distance from one another, the spaced distance being greater than width of the concavity;

said wedge also having concavities on rear of said wedge, with said concavities separated a spaced distance from one another, the spaced distance being greater than the width of the concavity; and a hook means on the second end of said elongated arm for grasping an article.

* * * * *